United States Patent [19]

Kuerston

[11] Patent Number: 4,563,247

[45] Date of Patent: Jan. 7, 1986

[54] RETORT WITH ANTI-BRIDGING MECHANICAL AGITATOR

[75] Inventor: Richard D. Kuerston, Bartlesville, Okla.

[73] Assignee: Phillips Petroleum Company, Bartlesville, Okla.

[21] Appl. No.: 608,846

[22] Filed: May 10, 1984

[51] Int. Cl.[4] ..... C10B 7/04

[52] U.S. Cl. ..... 202/265; 196/123; 196/124; 201/33; 202/119; 366/255; 366/258

[58] Field of Search ..... 202/265, 175, 119; 196/123, 124; 201/33, 34; 366/241, 255, 256, 257, 258, 332, 337, 334, 335; 208/8 R, 11 R

[56] References Cited

U.S. PATENT DOCUMENTS

| | | | |
|---|---|---|---|
| 235,942 | 12/1880 | Elmenhorst | 202/265 |
| 297,535 | 4/1884 | Otis | 366/332 |
| 307,629 | 11/1884 | Church | 366/241 |
| 543,791 | 7/1895 | Wood | 15/104.16 |
| 730,359 | 6/1903 | Fladby | 15/149 |
| 955,978 | 4/1910 | Mitchell | 366/254 |
| 1,070,147 | 8/1913 | Lockwood et al. | 366/241 |
| 1,180,387 | 6/1931 | Bianchi et al. | 24/236 |
| 1,255,626 | 2/1918 | Moore | 366/308 |
| 1,530,896 | 3/1925 | Hird | 202/265 |
| 1,570,131 | 1/1926 | Day | 196/124 |
| 1,711,114 | 4/1929 | Hunt | 416/142 |
| 2,615,834 | 10/1952 | Poindexter et al. | 202/119 |
| 2,616,680 | 11/1952 | Rodgers | 263/41 |
| 2,684,213 | 7/1954 | Robert et al. | 244/8 |
| 2,896,926 | 7/1959 | Chapman | 366/332 |
| 3,480,512 | 11/1969 | Vorum | 202/265 |
| 3,561,927 | 2/1971 | Jones | 23/283 |
| 3,640,849 | 2/1972 | Trainer | 202/265 |
| 3,736,247 | 5/1973 | Jones, Jr. et al. | 208/11 |
| 3,841,992 | 10/1974 | Jones, Jr. et al. | 208/11 |
| 4,017,043 | 4/1977 | Barzda | 244/138 |
| 4,029,220 | 6/1977 | Greaves | 214/35 |
| 4,090,945 | 5/1978 | Reeves | 208/11 |
| 4,094,769 | 6/1978 | Brown | 208/11 |
| 4,116,810 | 9/1978 | Jones, Jr. et al. | 201/34 |
| 4,134,738 | 1/1979 | Bress et al. | 202/265 |
| 4,221,638 | 9/1980 | Jones | 202/121 |

FOREIGN PATENT DOCUMENTS 2081432 2/1982 United Kingdom .

OTHER PUBLICATIONS

Hendrickson, T. A., Synthetic Fuels Data Handbook, Denver, Cameron Engineers, Inc., 1975, pp. 70–73.

Maurer, R. E., "Case Studies: Industrial Low-BTU Gasification" In: Thumann, A., ed., The Emerging Synthetic Fuel Industry (Atlanta, The Fairmont Press, Inc., 1981), pp. 96–106.

*Primary Examiner*—Jay H. Woo
*Assistant Examiner*—M. McGurk

[57] ABSTRACT

An apparatus for the destructive distillation of hydrocarbonaceous solids in a retort, wherein a viscous bridging zone comprising viscous liquids in intimate contact with solids, which tends to impede the flow of vaporized hydrocarbons and the flow of solid particles, is agitated by reciprocating mechanical means actuated by a rotatable crankshaft.

3 Claims, 8 Drawing Figures

RETORT WITH ANTI-BRIDGING MECHANICAL AGITATOR

BACKGROUND OF THE INVENTION

This invention relates to methods and apparatus for obtaining hydrocarbons from hydrocarbonaceous solids. In one aspect, this invention relates to methods and apparatus for facilitating the retorting of hydrocarbonaceous materials to produce useful hydrocarbons. In another aspect this invention relates to the destructive distillation of hydrocarbonaceous solids such as oil shales, tar sands, coal, lignite, peat, and the like. In another aspect this invention relates to means to counteract coalescing or swelling conditions in retorts.

Certain sedimentary rocks, commonly referred to as oil shale, on destructive distillation will yield a condensable liquid which is referred to as a shale oil and non-condensable gaseous hydrocarbons. The condensable liquid may be further refined into products which resemble petroleum products.

Other types of carbonaceous materials, both as an inclusion in rock, shale, sand, etc., or as a relatively low gangue content carbonaceous material, can be treated in a heating process for the recovery of valuable products. Such materials as coal, tar, tar sands, asphalts, peat, and the like are amenable to heating processes, to produce gases as well as hydrocarbonaceous liquids.

In its fundamental aspects, the destructive distillation of oil shale, or other solid hydrocarbonaceous materials, involves heating the solid material to a proper temperature and recovering the products which are emitted. In various attempts at retorting to date, the most common approach is the heating of beds of relatively small particulate oil shale and providing a stream of hot gas flowing through the shale bed. Since a solid and a gas are the major components of the system, countercurrent operation is the most conventional process encountered in the prior art. Because the destructive distillation takes place at a relatively high temperature, thermal efficiency dictates that the exhausting off gas and the exhausting spent shale leave the reaction vessel at a relatively low temperature. Various countercurrent retorting processes have been described, including one in which solids are mechanically moved upward and hot gases plus the retorted oil move downward, as described in the Synthetic Fuels Data Handbook, (Cameron Engineers, Inc., Denver, Colo., 1975) pp. 70–73.

From a practical consideration of the various processes, it has been found that the retorting should generally include a downward gravity feed of the solids through the retorting vessel and an upward rising gas and entrained liquid flow. This situation utilizes incoming cold solids to cool the rising stream of gases so that it leaves the bed at a relatively low temperature. In the same manner incoming gases are brought into the lower part of the solids bed to cool the retorted solids and to heat the gases to a desired temperature.

From a practical consideration, an effective oil shale retorting process has been achieved in a vertical shaft kiln by a gravity flow, continuously moving shale bed in the kiln. A constant height bed is produced by feeding solids to the top of the bed and withdrawing solids from the bottom to maintain the uniform depth of the bed. The retort includes at least three vertically aligned zones, for example a top preheating zone for the shale (which, also, provides for the disengagement of the products of the pyrolysis from the raw shale), a mid zone for pyrolysis and a lower cooling zone below the pyrolysis zone. In addition, fresh shale at relatively unelevated temperatures falls onto and resides materially on the top preheating zone. This process utilizes incoming ambient temperature solids to cool the rising stream of the produced products from the pyrolysis, so that the product streams leave the bed at a relatively low temperature. For an economic heat balance, the shale leaving the pyrolysis zone is cooled by bottom injected, incoming cool gas. This gas is heated by the hot shale and rises up through the particulate oil shale, through the retorting zone and is subsequently withdrawn as off-gas with the produced pyrolysis products.

Generally speaking, two major processes have been proposed for pyrolysis reactions in the vertical or shaft kiln, the first being a direct combustion process in which residual carbon on the shale is burned in the kiln, producing the heat for the pyrolysis, and the second being an indirect heat retorting in which a non-oxygenous gas is heated externally of the retort and is introduced immediately below the retoring zone, with the incoming heated gas being of a sufficient temperature to produce pyrolysis.

It has been noted, e.g. in U.S. Pat. No. 4,116,810, Column 4, that operation of an oil shale retort or kiln in an indirect heat retorting mode tends to produce cracking, coking and a general coalescing of solid material in the retort. Such coalescing can form agglomerates which impede the flow of the shale through the retorting zone, whether by gravity or mechanical feed. When a viscous liquid contacts solids a mass sometimes forms exhibiting very high apparent viscosities and which has a tendency to be immovable, thus bridges over or impedes the normal movement and flow of solid and liquid within the retorting apparatus.

Similar problems are encountered in the retorting of other hydrocarbonaceous solids, e.g. the fixed bed coal gasifiers described in U.S. Pat. No. 4,134,738. In addition to the formation of clinkers, or coal residues which have become fused together, when coal is heated in the absence of oxygen, the coal structure expands, or swells. The free swelling index is used as a measure of the amount of swelling experienced by the coal. Generally, the use of coals with free swelling indexes of greater than about 2.7 is regarded as impractical in certain types of fixed-bed gasifiers, since the coal will swell and plug the distillation zone of the gasifier. However, by agitating or poking such a coal bed, the gases causing the swelling can be released from the coal structure, thus permitting the use of coal with relatively high free swelling indexes in either fixed-bed or gravity-feed gasifiers.

Various devices are available for agitating beds of solid particles in heated retorts. For example, Bress et al discloses in U.S. Pat. No. 4,134,738 (1979) an automatic poking system for a fixed-bed coal gasifier in which multiple poke rods are actuated in a reciprocating manner to agitate the coal bed. Davis discloses in British Patent Application No. 2,081,432 (1982) a similar poking system for such coal gasifiers in which at least one reciprocable pokerod is mounted on a movable carriage to permit its use at multiple pokeholes in the retort. Despite the extensive development of such apparatus, there is a need for simple yet effective systems for agitating beds of solids in various types of retorts.

In oil shale retorts, whether directly or indirectly heated, operation of the retort tends to produce a relatively shallow zone above or below the retorting zone where viscous liquids come in contact with solids to form bridges or agglomerates which impede the flow of oil mist and gases as well as the movement of shale particles. This zone will hereinafter be referred to as the "viscous bridging zone" in reference to various retorts for processing hydrocarbonaceous solids as well as specific oil shale retorts. In a vertical, gravity-feed retort, there is generally a layer of fresh oil shale on top of the viscous bridging zone. There is a need for improved methods of agitating such viscous bridging zones to facilitate the flow of oil mist, gases and shale particles.

SUMMARY OF THE INVENTION

An object of this invention is to penetrate and agitate the viscous bridging zone in a retort for pyrolysis of hydrocarbonaceous material to break up viscous masses to facilitate the normal flow of gases and solids through the retort.

Another object of this invention is to provide apparatus for penetrating and agitating such a viscous bridging zone, comprising at least one mechanical agitator.

It is another object of this invention to provide a mechanical agitator to prevent bridging of shale oil-oil shale compositions in a shale oil retort.

A further object is to facilitate the flow of oil mist and gases, and the movement of solid shale particles, in a shale oil retort.

While this invention will be described as applicable to a vertical, gravity-feed retort in which solid particles move downward and hot gases and oil mist move upward, the invention is applicable to any countercurrent retorting system, and thus should not be considered as limited to this embodiment. Specifically, it is within the scope of this invention that the agitating or pushing system of this invention be used in a retort in which the solids are moved upwardly while the fluids flow downwardly.

In accordance with this invention, a method and apparatus are provided for agitating a viscous bridging zone in a retort for the destructive distillation of hydrocarbonaceous solids. The apparatus of this invention comprises at least one reciprocating mechanical agitator driven by at least one rotatable crankshaft. The apparatus preferably comprises at least one crankshaft, said shaft supporting and driving at least one reciprocating agitator such as anti-bridging pushrods, wherein said rods move downward and upward, said pushrods having on their lower ends means for exerting downward and upward pressure such as a bevelled enlargement of hardened metal to provide pushing, wedging and lifting actions when moving upward and downward through a viscous shale oil-oil shale mass or bridging zone. In an embodiment, the pushrods comprise folding scoop arms in lieu of or in addition to the enlargement at their lower ends.

In order to keep the anti-bridging rods essentially vertical, horizontal guide frames are provided below and essentially parallel to the rotating crankshaft. Said guides and guide supports are generally in a position such as in an outer segment of the retort cross section area, so as to not impede the downward movement of shale from the preheat zone to the combustion zone. Said guides are sufficiently strong and of high strength metal for elevated temperatures and are located low enough in the retort to avoid large bending moments (force times distance to fulcrum) of both the guides and anti-bridging rods as said rods agitate the viscous oil shale.

It is emphasized that although this invention will be discussed in relation to oil shale retorts, the invention is generally applicable to any system for the retorting, pyrolysis or destructive distillation of hydrocarbonaceous solids, whether directly or indirectly heated, vertical or horizontal, gravity or mechanical feed. The solids, gases, mists and liquids can move in any direction through the retort, including vertically, horizontally or on an incline. When heat is provided by hot gases, they preferably pass through the retort in a direction countercurrent to the movement of the solid particles. Indeed, the invention can be applied to any system wherein agglomerates of solids and/or viscous liquids require agitation.

When the term hydrocarbonaceous solids is used, it is intended to include oil shales, coal, tar sands, gilsonite or mixtures of such hydrocarbonaceous solids with each other and/or inert materials. The term oil shale is intended to mean inorganic material which is predominantly clay, shale or sandstone, in conjunction with organic hydrocarbonaceous material composed of carbon, hydrogen, sulfur, oxygen and nitrogen which is called kerogen.

Other objects and advantages of the invention will be apparent after studying the following detailed description, the appended claims, and the accompanying drawings in which:

DETAILED DESCRIPTION OF THE INVENTION

Figure 1:
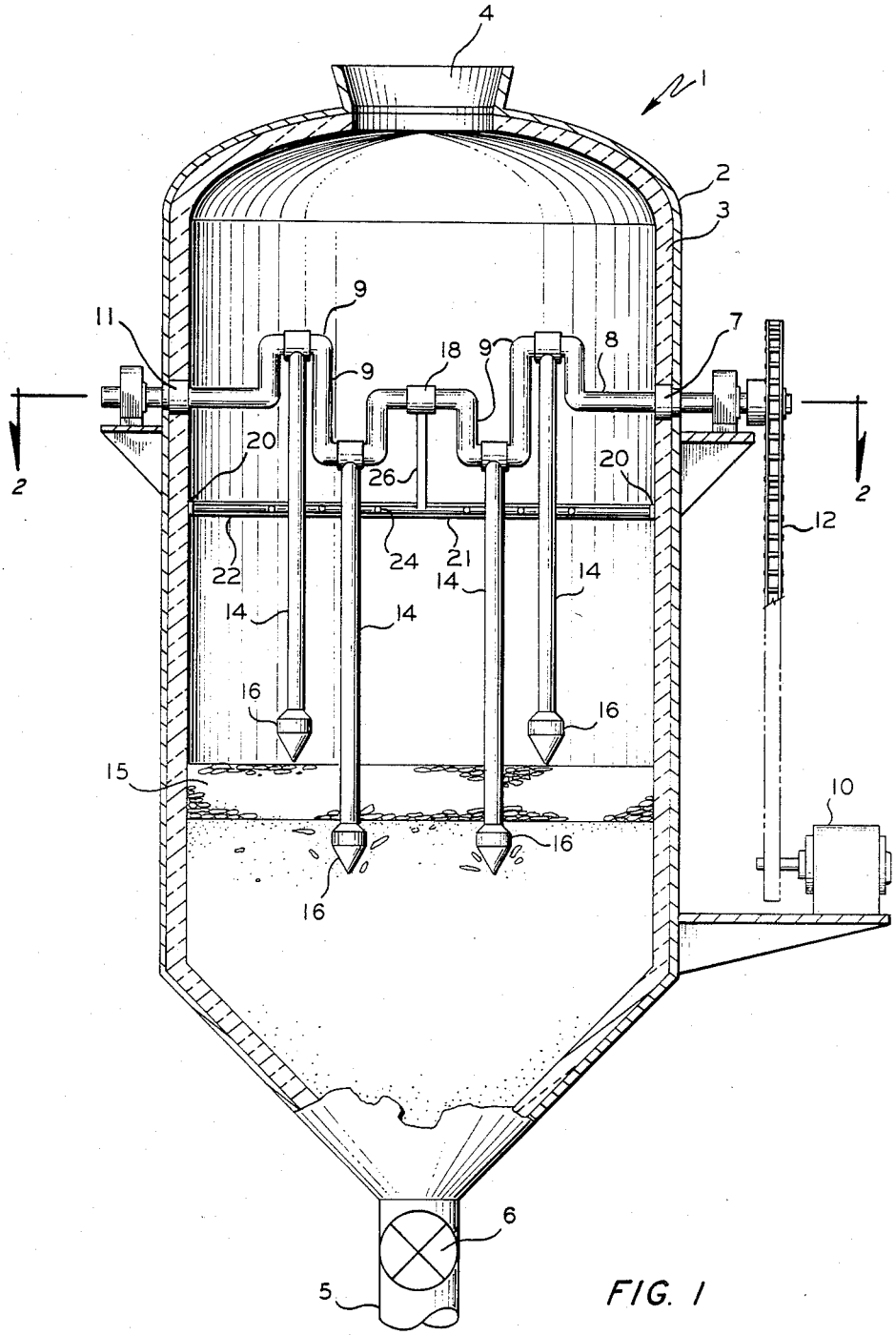
FIG. 1 is a schematic elevation partially in section representing a retorting vessel in accordance with the invention.

Referring now to the drawings, wherein like reference numerals are used to denote like elements and particularly to FIG. 1, in an embodiment of the invention a retorting vessel 1 comprises a metal shell 2 having a refractory lining 3. The retorting vessel 1 is preferably situated in a generally vertical position with a height-to-diameter ratio of at least 1 to 1. It is preferred that the length or height of the retorting vessel be a number of times its diameter in order to conserve energy requirements for heating the vessel and for removing the product.

A hopper 4 of any suitable construction is attached to the top of the retorting vessel 1 (or other suitable location) in a manner which will allow a continuous feed of hydrocarbonaceous solid particles. The bottom of the retorting vessel 1 terminates in the form of a centrally positioned conduit 5 having a suitable valve means 6 such as a star valve or the like. Although the upper portion of the retorting vessel 1 is drawn as a circular cylindrical shape, the shape may be rectangular, square, polyhedral or the like. The rate of the descent of the hydrocarbonaceous solids through the vessel may be controlled by regulating the rotational speed of the star valve 6. Other means may be employed to regulate the rate of descent, such as movable grates in the bottom of the retort or the like.

The apparatus of this embodiment of the invention comprises a motor driven crankshaft 8 driven by motor 10 via gears and belt 12, said crankshaft 8 having a plurality of bends to give eccentric portions or crank arms 9 of the crankshaft parallel to, but not superimposed upon, the main axis of the rotatable crankshaft. At each said eccentric bend, hereinafter termed a crank arm, is attached a vertical pushrod 14, said rods moving reciprocatively downward and upward through a portion of the retort, which has a region 15 of viscous agglomerated particles, e.g. shale oil-oil shale masses, said masses causing bridging and constraint of the downward flow of solid shale. The crankshaft is at least partially supported by bearings 7, 11 and 18. Fresh oil shale (not shown) falls onto region 15.

The apparatus of this invention must be designed and constructed to withstand the temperatures and physical stresses expected in the reactor where it will be employed, using high temperature resistant materials such as stainless steel, tungsten, tungsten carbide, titanium, nickel alloys and the like. It is preferred to use such metals as tungsten carbide or titanium which have high tensile strength at temperatures in the range of 2000°-2500° F. Lubrication for the crankshaft support bearings and the connections of the pushrods to the crankshaft preferably utilizes a high temperature lubricant comprising at least one lubricant such as graphite. The lower ends of vertical rods 14 have upper and lower bevelled enlargements 16, preferably formed of hardened, heat-resistant metal to provide a wedging, pushing and lifting action when rods 14 are moving upward and downward through the viscous bridging zone 15, thus keeping the viscous masses agitated. The enlargements 16 can also be bevelled on the lower surface only, the upper surface being flattened to provide primarily a lifting action. Although it is within the spirit and scope of this invention to employ a single rotatable crankshaft with at least one pushrod, it is preferred to have at least one crankshaft with a plurality of attached vertical anti-bridging pushrods, controlling bridging action wherever it can occur, insofar as practicable. The pushrods are preferably constructed so that they are relatively light, strong and rigid, but having enough flexibility to flex rather than break under compressive stress at the temperatures encountered. Such requirements can be met, e.g. by making the rods of steel tubing of suitable size and specifications. The pushrods are guided by guide mechanism 21, discussed below.

Figure 2:
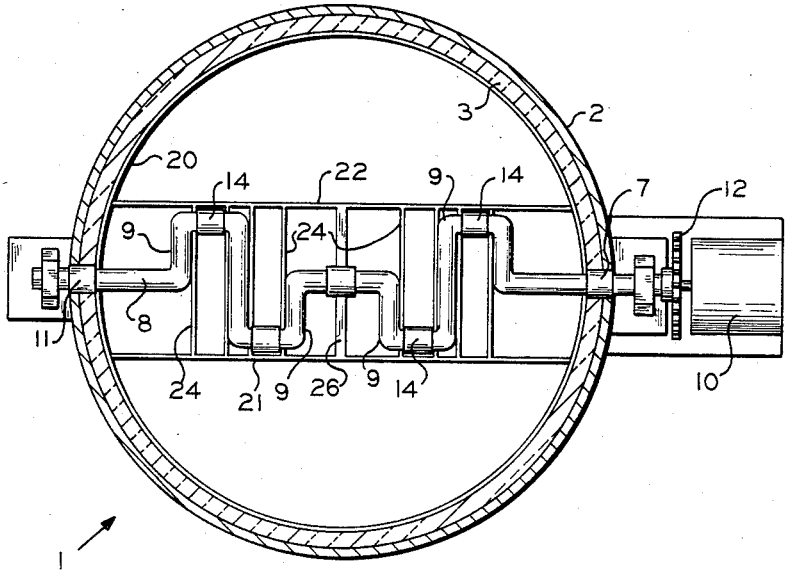
FIG. 2 is a cross section along the lines 2—2 of FIG. 1.

FIG. 2 illustrates essentially a section 2—2 through retort 1 to show a top view of the rotable eccentric crankshaft 8 and upper end crank arm connections of vertical anti-bridging pushrods 14, plus guide mechanism 21.

Figure 3:
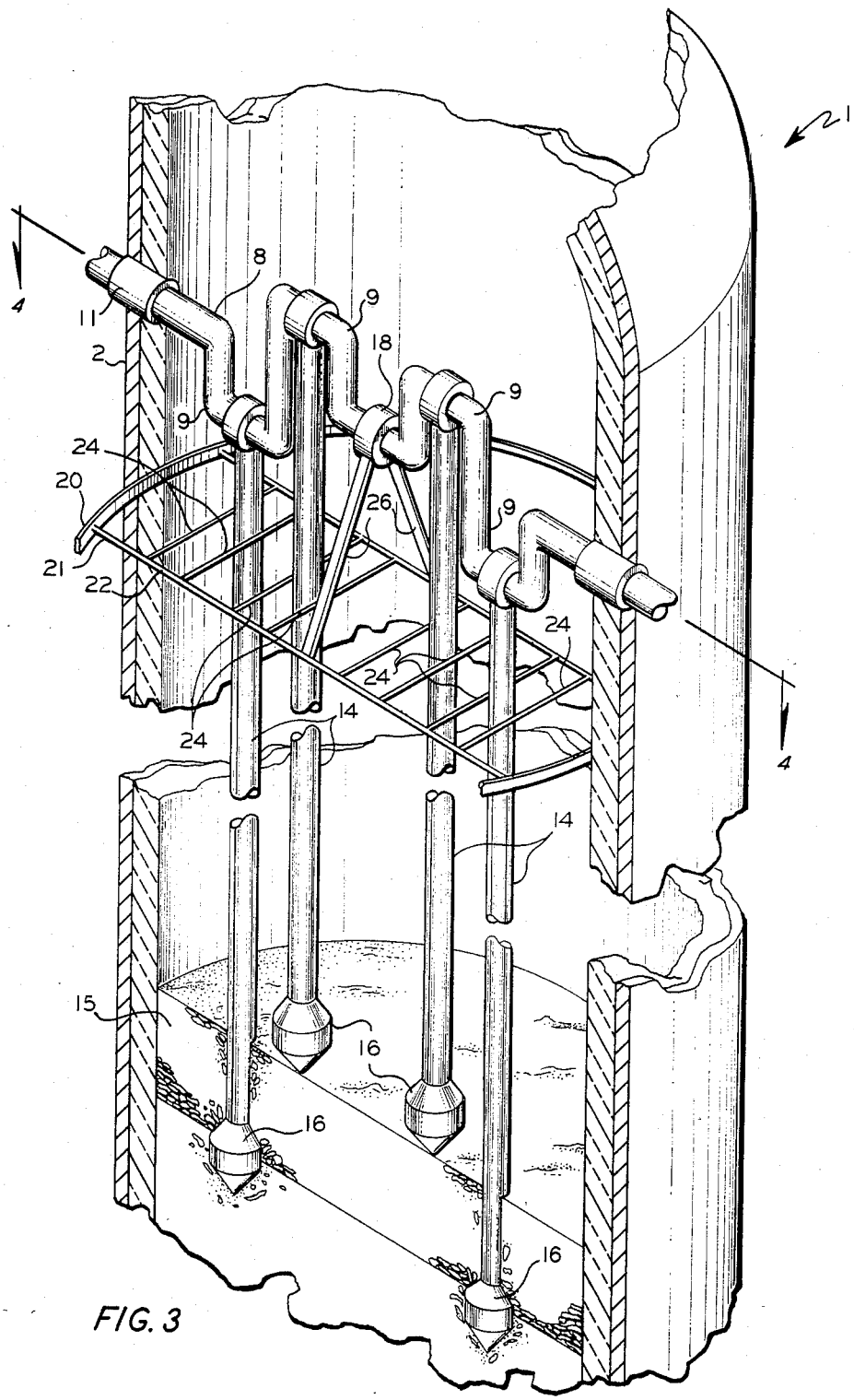
FIG. 3 is an isometric elevation partially in section of the rotating crankshaft, anti-bridging rods, and rod guides.

In further illustration of the invention, an isometric sketch FIG. 3 is presented of the vertical retort 1 shown partially in sectional view. The sectional view of the rotatable crankshaft 8 is shown to illustrate the manner in which anti-bridging pushrods 14 are connected to crankshaft 8. The anti-bridging pushrods 14 with double bevelled lower ends 16 are shown in relation to the viscous bridging zone 15. Zone 15 lies below the level where fresh oil shale accumulates (not shown).

In order to keep rods 14 in essentially vertical positions when crankshaft 8 is rotating, a guide mechanism 21 is shown located below rotatable crankshaft 8. This guide mechanism also serves to support crankshaft 8 at main bearing surface 9, at essentially the shaft center, by bearing shaft support beams 26.

The guide mechanism consists of a support ring 20 located on and attached to retort shell 2 in an essentially horizontal orientation, the plane of which is below and parallel to crankshaft 8. Attached to ring 20 are two beams 22 essentially parallel to crankshaft 8, which span the distance across retort shell 2. Attached across the distance between beams 22 are guide bars 24 on each side of rods 14. Near the center of the beams 22 are attached at least two bearing shaft support beams 26 supporting the shaft center support or bearing 18. If necessary, additional main bearing surfaces and bearing shaft supports can be provided to support the crankshaft bars. Ring 20, beams 22 and bars 24 are located sufficiently low in the retort to avoid large bending moments (force times distance) against said beams or bars by rods 14 as they agitate viscous oil shale zone 15.

As the crankshaft 8 rotates, guide beams 22 serve to keep rods 14 in essentially a vertical position and avoid disarrangement of rods 14 into modes other than essentially vertical as the rods 14 plunge upward and downward through bridging zone 15.

Figure 4:
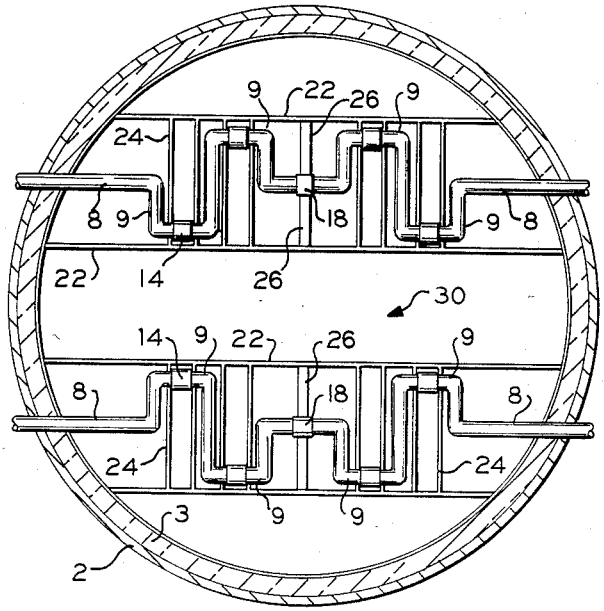
FIG. 4 is a cross section along the lines 4—4 of FIG. 3 showing the position of the apparatus relative to the retort cross section and remaining open area of the retort cross section.

To illustrate further an embodiment of this invention, section 4—4 of FIG. 3 is shown in FIG. 4. FIG. 4 shows one possible configuration comprising two crankshaft anti-bridging mechanisms. FIG. 4 shows two rotatable shafts 8 located in segmental areas of retort 1 cross section above guide support mechanisms as previously described in FIG. 3, leaving central area 30 open for the free movement of fresh shale.

Figure 5:
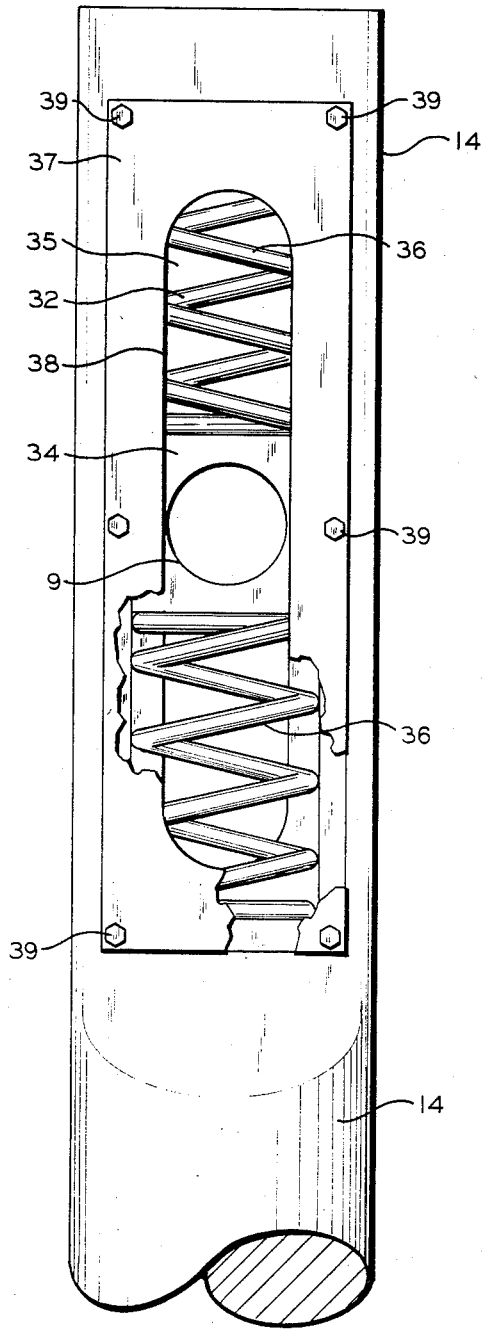
FIG. 5 is an embodiment of the connection between an anti-bridging rod and the crankshaft with interior springs in the rod sockets.

FIG. 5 shows an embodiment of the connection between the anti-bridging pushrod 14 and crankshaft 8 such that springs 36 above and below the crankshaft 8 connection to said anti-bridging rods 14 allow said rods 14 to absorb shock rather than exert excessive stress upon crankshaft 8 in the event of severely hard resistance encountered in viscous bridging zone 15 (of FIGS. 1 and 3). Pushrod 14 is at least partially hollow so as to define a chamber 35 therein. The shock absorbing mechanism illustrated includes a sliding block 34 which is slideably mounted within the chamber 35. Two springs 36 are provided wherein a first spring is mounted in the chamber above block 34 such that the lower end of the first spring abuts the upper end of block 34. A second spring is mounted in chamber 35 below block 34 such that the upper end of the second spring abuts the lower end of the block. The crank arms 9 of crankshaft 8 are inserted through a hole in sliding block 34. Springs 36 are of a diameter larger than the bearing surface of crank arm 9. Two cover plates 37 with slot 38 slightly larger than the diameter of crank arm 9 are securely placed over both sides of chamber 35 with bolts 39 to hold the springs in place as crank arm 9 compresses or extends springs 36 in the upward and downward movement of rod 14 as it penetrates or lifts bridged shale 15. As shown, slots 38 are on opposite sides of pushrod 14, the hole in block 34 being aligned with the slots.

Figure 7:
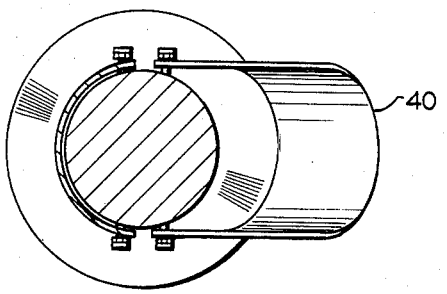
FIG. 7 is a cross section of the rod along the lines 7—7 of FIG. 6.
Figure 8:
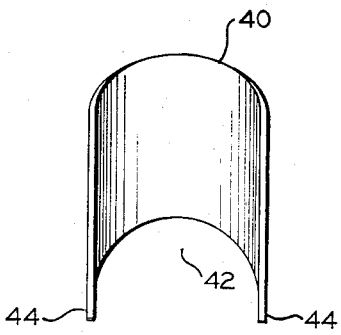
FIG. 8 is a top view of one of the folding scoop arms, as seen between lines 8—8 of FIG. 6.
Figure 6:
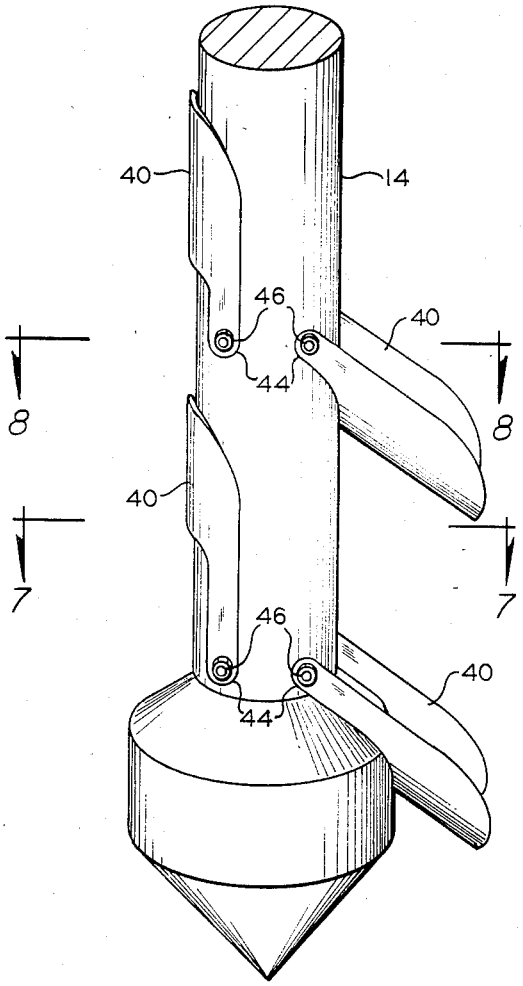
FIG. 6 is an isometric elevation of an anti-bridging rod with double-bevelled enlargement and folding scoop arms.

FIGS. 6, 7 and 8 illustrate an embodiment in which folding scoop arms 40 are pivotally attached to the anti-bridging rods 14 in lieu of, or in addition to, the double-bevelled enlargements at the rod tips. As shown, scoop arms 40 are attached to no member other than pushrod 14. Such scoop arms can be conveniently formed in various suitable shapes from blanks of sheet metal of suitable strength, thermal resistance and stiffness, and reinforced as necessary. In forming the scoop arms, the base portion is cut out in a pattern 42 leaving extensions or "ears" 44 which can be drilled and twisted to pivotally fasten the scoop arm to the rod by bolts 46, pins or the like. The base portion can be cut out so as to form a stable support for the scoop arm against the rod or the bevelled enlargement. The scoop arms 40 can be cut out to rest at almost any angle to the rod, and are shown on the right side of rod 14 at an obtuse angle as measured from the upper portion of the rod. Each scoop arm 40 is pivotable about an axis which is perpendicular to the longitudinal axis of the scoop arm. Further, each arm is mounted so as to be movable between two limiting positions. In a first, or folded, limiting position, a scoop arm is folded against pushrod 14 such the arm axis lies generally parallel to the pushrod longitudinal axis. In a second, or unfolded, limiting position, an arm extends from pushrod 14 so that the arm axis is nonparallel with respect to the pushrod axis so as to form an angle with the pushrod axis. Any suitable number of the scoop arms 40 can be installed at various points along the rods, but they are preferably installed in pairs or other symmetric patterns around the periphery of the rods to equalize forces exerted in operation. In operation, the scoop arms will tend to retract when the rods thrust into the bed of particles on the down stroke, thus assuming the first, or folded, position shown at the left side of rod 14 of FIG. 6. The scoop arms assume the second, or unfolded, position shown on the right side of rod 14 on the upstroke. The cutout portion 42 of the base should permit particles resting in the scoop arms to drop out as the scoop arms are elevated and folded against the rod. After the rods have entered the bed of particles, preferably penetrating a viscous bridging zone or other agglomerated area, they will reach the low point of their travel and begin an upstroke as the crankshaft rotates. As the rod is lifted, the scoop arms will extend, lock in extended position, as shown at the right side of rod 14 of FIG. 6, and exert lifting force to agitate the bed. Depending upon the characteristics of the materials to be agitated and the strength characteristics of the rods and arms, it may be preferred that the arms describe an acute, right, or obtuse angle to the rod when in extended position.

It is understood that a variety of configurations of rotatable crankshafts 8 are possible. Said shafts may be located near the peripheral segmental areas of retort 1 such that an area 30 (FIG. 4) is available to allow movement of shale downward through retort 1. Such rotable shafts can also be located in retorts of a cross sectional shape different from a circle, such as elliptical, square, rectangle, polyhedral or the like. Although not shown, it is within the scope of this invention to shield the crankshaft apparatus from the impact of falling shale by including a peaked roof of suitable material which slopes and overhangs said apparatus.

While this invention has been described in detail for the purpose of illustration, it is not to be construed as limited thereby, but is intended to cover all the changes and modifications within the spirit and scope thereof.

I claim:

1. An apparatus for use in retorting of hydrocarbonaceous solids comprising:

a hollow retort vessel;

at least one pushrod having a longitudinal axis disposed within said vessel;

means for moving said at least one pushrod reciprocatively downward and upward through a portion of the retort;

at least one scoop arm pivotally attached to said at least one pushrod, said at least one scoop arm being attached to no member other than said at least one pushrod.

2. An apparatus as recited in claim 1, wherein said scoop arm has a longitudinal axis and is pivotable about an axis generally perpendicular to the arm axis, said arm being mounted so as to be movable between a first limiting position and a second limiting position, where in the first limiting position said arm is folded against said pushrod such that the longitudinal axis of said arm lies generally parallel to the pushrod axis, and where in the second position said arm extends from said pushrod so that the longitudinal axis of said arm is nonparallel with respect to the pushrod axis so as to form an angle with the pushrod axis, and wherein said scoop arm is mounted to said pushrod so that said arm assumes said first position on the downstroke of said pushrod and so that said arm assumes said second position on the upstroke of said pushrod.

3. An apparatus for use in retorting hydrocarbonaceous solids comprising:

a hollow retort vessel;

at least one pushrod disposed within said vessel, said at least one pushrod being at least partially hollow so as to define a chamber therein, wherein said at least one pushrod has slots on opposite sides thereof in communication with said chamber;

a spring mechanism mounted within said chamber which includes a block, having an upper end and a lower end, slideably mounted within said chamber, said block having a hole therethrough in alignment with the slots, the mechanism also including a first spring, having an upper end and a lower end, mounted in said chamber above said block such that the lower end of said first spring abuts the upper end of said block, and a second spring, having an upper end and a lower end, mounted within said chamber below said block such that the upper end of said second spring abuts the lower end of said block;

a crankshaft which extends through said hole in said block; and means for rotating said crankshaft.

* * * * *